US005700355A

United States Patent [19]

Prough

[11] Patent Number: 5,700,355

[45] Date of Patent: Dec. 23, 1997

[54] CHIP FEEDING FOR A CONTINUOUS DIGESTER

[75] Inventor: J. Robert Prough, Queensbury, N.Y.

[73] Assignee: Ahlstrom Machinery Inc., Glens Falls, N.Y.

[21] Appl. No.: 547,159

[22] Filed: Oct. 24, 1995

Related U.S. Application Data

[62] Division of Ser. No. 267,171, Jun. 16, 1994, Pat. No. 5,476,572.

[51] Int. Cl.[6] ..... D21C 7/06; D21C 7/08; B65D 88/26

[52] U.S. Cl. ..... 162/246; 222/185.1; 222/460

[58] Field of Search ..... 162/52, 246; 222/185.1, 222/460

[56] References Cited

U.S. PATENT DOCUMENTS

| | | | |
|---|---|---|---|
| 3,303,088 | 2/1967 | Gessner | 162/19 |
| 5,500,083 | 3/1996 | Johanson | 162/17 |

FOREIGN PATENT DOCUMENTS

| | | |
|---|---|---|
| 407371 | 1/1991 | European Pat. Off. . |

OTHER PUBLICATIONS

"Binside Scoop", JR Johanson, Inc., Jun. 6–8, 1993.

*Primary Examiner*—Donald E. Czaja
*Assistant Examiner*—Dean T. Nguyen
*Attorney, Agent, or Firm*—Nixon & Vanderhye P.C.

[57] ABSTRACT

A chip feeding system for a continuous digester provides for a greater rate of delivery of chip slurry to the digester, and is much less expensive than conventional chip feeding systems, typically being only 40–50% of the height of the conventional system. An atmospheric vessel may be connected at the bottom thereof to a slurry pump which pumps the chip slurry to a conventional high pressure feeder. A recirculation loop for returning liquid from the feeder to the vessel may include an atmospheric level tank, and a liquid cooler. The vessel may have one dimensional convergence and side relief, and instead of a conventional cylindrical chip bin, the chip bin may have a hopper having two transitions with one dimensional convergence and side relief. The chip bin also may be at atmospheric pressure so that no low pressure feeder between the bin and vessel is necessary. Alternatively, the vessel may be pressurized while an atmospheric-pressure level tank is provided, the high pressure feeder being mounted directly at ground level.

11 Claims, 6 Drawing Sheets

*fig. 10*
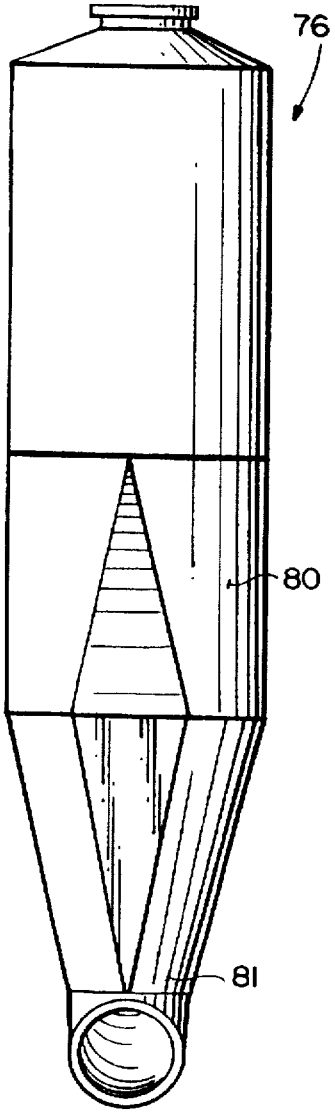
*fig. 11*
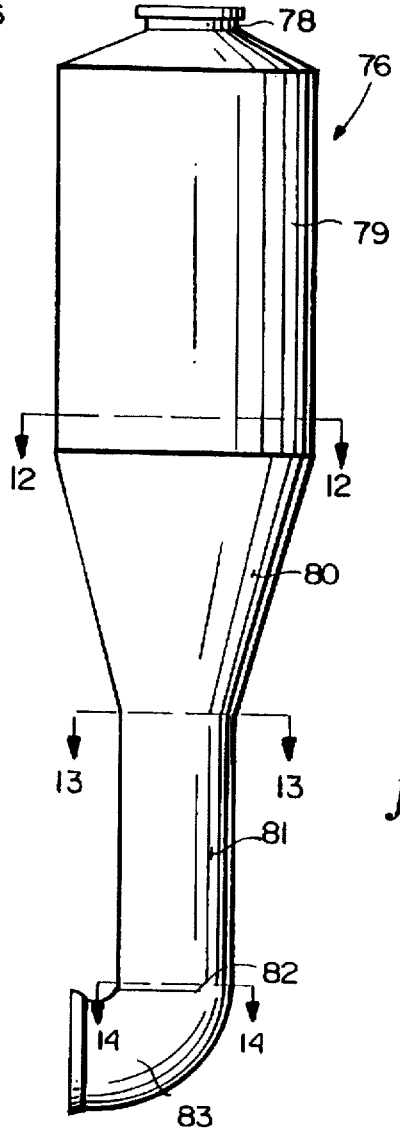
*fig. 12*
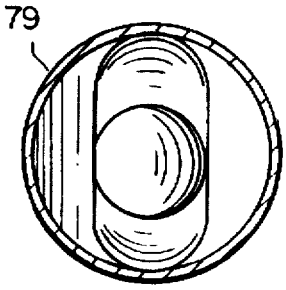
*fig. 13*
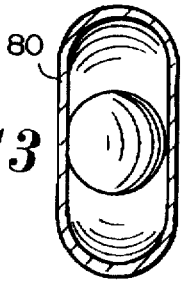
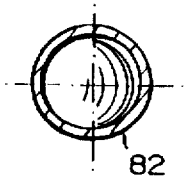
*fig. 14*

CHIP FEEDING FOR A CONTINUOUS DIGESTER

This application is a division of application Ser. No. 08/267,171, filed Jun. 16, 1994 now U.S. Pat. No. 5,476,572.

BACKGROUND AND SUMMARY OF THE INVENTION

In the pulping of comminuted cellulosic fibrous material, such as wood chips, in the continuous digester the material is treated to remove entrapped air and to impregnate the material with cooking liquor while raising its pressure and temperature (e.g. to 150° C. and 165 psi). Typically, the chips are steamed to purge them of air while simultaneously increasing their temperature, passed through air locks to raise their pressure, impregnated with heated cooking liquor, and then transported as a slurry to the digester.

In the past, in order to accommodate the purging, heating, pressurizing, and feeding functions, an apparatus is provided that is bulky, tall, and expensive. Normally a special building or super structure must be built to house or support this equipment. Such a building or super structure is built with structural steel and concrete, requires utilities, stairwells, and other accouterments, and contributes greatly to the cost of a continuous digester system. Also, the cost of the conveyor which transports chips to the inlet to the system is highly dependent upon the overall height of the system, which is typically on the order of about 115 feet for a digester which has a capacity of about 1,500 tons per day.

According to the present invention a system is provided for delivering a slurry of comminuted cellulosic fibrous material to a continuous digester that has numerous advantages compared to the prior art. According to the present invention, the delivery system is much less massive, tall, and expensive than the conventional systems. For example, the system according to the present invention may have a height of only about 60 feet for the same size digester that the prior art systems would have a height of 115 feet. Also, the system according to the present invention has a higher delivery capacity—that is, for a particular size of equipment, it can deliver more slurry to the top of the digester per unit time. Because of the much smaller size of the system according to the present invention, the prior art building or super structure can be eliminated or downsized so that it is significantly more economical, leading to a complete system which is much less expensive than prior art systems.

In the conventional delivery systems, the high pressure feeder, which is a high pressure rotary transfer device such as shown in U.S. Pat. No. 4,372,711, is mounted on an elevated concrete pedestal. Such a mounting is necessary because the draw-through system used for pulling chips from a chip chute through the high pressure feeder requires a minimum static head to operate effectively. The chip bin is typically a large cylindrical vessel, and it is connected by a chip feeder and a low pressure feeder to a horizontal steaming vessel, which in turn is connected to a vertical generally cylindrical superatmospheric pressure chip chute connected to the top of the high pressure feeder. The recirculation line, which includes a low pressure pump mounted below the high pressure feeder, includes a superatmospheric pressure level tank which controls the level of liquid in the chip chute.

According to the present invention, virtually every element of the delivery system, except for the high pressure feeder itself, is modified so as to reduce the height and bulk of the equipment, and in one case to also increase the effective capacity of the high pressure feeder.

According to one aspect of the present invention, which has the greatest single affect in minimizing the height, and simultaneously increasing the effective capacity of the high pressure feeder, a modification to the low pressure circulation line associated with the high pressure feeder is provided. Instead of the chip chute on top of the high pressure feeder and the chip chute pump below the high pressure feeder, providing a "suck through" system, a pump-through system is provided according to this aspect of the present invention. According to this aspect of the invention a system for delivering chip slurry to the continuous digester comprises: A high pressure rotary transfer device having a low pressure inlet, low pressure outlet, high pressure inlet, and high pressure outlet, the high pressure outlet operatively connected (e.g., directly, through an impregnation vessel, or the like) to a continuous digester for feeding comminuted cellulosic fibrous material slurry to the digester. A vessel at substantially atmospheric pressure containing a slurry of comminuted cellulosic fibrous material, and having a top, a bottom, and an outlet adjacent the bottom. A slurry pump connected between the vessel outlet and the transfer device low pressure inlet. And, a recirculation loop for returning liquid from the transfer device low pressure outlet to the vessel. The vessel, slurry pump, and high pressure transfer device are typically mounted substantially at ground level. That is, one need not be mounted on top of the other, and no concrete pedestal is necessary to mount the high pressure feeder.

The recirculation loop of the system according to the invention typically includes an in-line drainer connected to a substantially atmospheric pressure level tank for controlling the level of slurry in the vessel. In order to avoid water hammer due to flashing of liquid in the high pressure feeder, a means for lowering the temperature of the recirculating liquid in the recirculation loop, such as a liquid cooler (indirect heat exchanger), or a vessel which allows the liquid to flash, is provided. Temperature sensors can be provided on opposite sides of the heat exchanger, and a controller can provide for controlling the flow of coolant through the heat exchanger in response to the temperature sensors. The temperature of the liquor in this return recirculation can also be controlled by cooling the white liquor before adding it. Similar methods to those used in U.S. Pat. No. 5,302,247 may be used to cool the white liquor. This white liquor cooling may be controlled based on the temperature sensed at upstream temperature sensor.

The system can also include a second (or even more) high pressure rotary transfer device which is fed by the same slurry pump. A flow control valve may be provided in the recirculation loop with pressure sensors for sensing the pressure between the slurry pump and the transfer device low pressure inlet, and the pressure in the recirculation line, controlling the flow control valve in response to the pressure sensors.

By utilizing the pump-through feed of chips as described above, the height of the chip delivery system can be reduced about 20–30 feet, with a commensurate simplification of associated equipment. The system also allows the high pressure feeder to run faster, and allows more than one feeder to be run in parallel, simplifying the design of new systems and increasing the capacity of existing systems. In a conventional draw-through design, the suction of the chip chute pump reduces the pressure at the bottom of the feeder. When slurry is at a temperature greater than 220° F. (a typical slurry temperature at the high pressure feeder is about 240°–260° F.) the reduction of pressure can cause flashing of the hot liquor and thus water hammer. The potential for inducing flashing increases as the speed of the feeder increases by causing increased pressure drop. The potential for inducing water hammer presently limits the speed at which conventional high pressure feeders can be operated. (Some feeders are typically limited to 11 rpm.) In the pump-through system according to the invention, since there is no suction at the liquor outlet, the potential for inducing water hammer is minimized, if not eliminated. Thus the high pressure feeder can be operated at higher speeds and increased capacity, allowing smaller units to be used in new systems, and allowing existing high pressure feeders to run at higher speeds and increased capacity.

The pump-through design also has the potential to increase the feeder capacity by allowing higher flows. As discussed above, flow in the chip chute circulation, i.e., from the chip chute, through the feeder, through the chip chute pump, etc. is limited due to pressure drop across the feeder and the potential for flashing. Since the potential to flash in the feeder is minimized in the pump-through system, higher liquor flows can be achieved without flashing. These higher liquor flows through the feeder will aid in filling the feeder pockets with chips, hence increasing the feeder's capacity.

The pump-through design also improves the efficiency of systems that may contain air or entrained gases in the chip chute slurry. The presence of air, or other gases, in the chip-liquor slurry reduces the flashing temperature of the hot liquor. Where liquor under 15 psig pressure may flash at 250° F., liquor containing trapped air under 15 psig may flash at somewhat lower temperatures, e.g., 230° F.

The pump-through system and the push-through system (i.e., the system with the pressurized chip chute and atmospheric level tank) are advantageous when air is present because the low-pressure areas, that create flashing, do not occur in and around the high-pressure transfer device. In the pump-through design, the low pressure area is in the atmospheric chip chute pump impeller. In the push-through system, the low-pressure area is in the atmospheric level tank where flashing can be beneficial to produce steam for pre-steaming.

According to another aspect of the present invention, the height of the delivery system is further significantly reduced by utilizing—in place of the conventional cylindrical chip bin—a hopper having two transitions with one dimensional convergence and side relief. The one dimensional convergence and side relief describes a configuration composed of two symmetrically oriented end surfaces that converge downward toward each other only in one dimension. Thus at any given cross-section, the surfaces will be reflections of each other around a horizontal center liner perpendicular to the singular direction of convergence. In its simplest form, the cross-section could be described by two parallel straight lines symmetrically oriented about a horizontal centerline also parallel to the two straight lines. Another cross-section form could be two semi-circles symmetrically oriented about a centerline parallel to the semicircular axis. The general case of the cross-section would be any surface symmetrically reflected about a horizontal centerline. At any other level of cross-section, the surfaces would be similar in shape.

Side relief, as applied to the sides of the above-described surfaces, refers to the horizontal lines connecting the two closest end points of the surface. At any given cross-section, these lines are perpendicular to the centerline and hence parallel to each other. The relief comes about in that each succeeding lower pair of horizontal lines forming the sides are further apart or the same distance apart relative to the lines immediately above them. This produces divergence or nonconvergence of the sides of the hopper. The general design of such a hopper is shown in U.S. Pat. No. 4,958,741 (the disclosure of which is hereby incorporated by reference herein), and detailed configurations suitable for use as chip bins are shown in co-pending application Ser. No. 08/189,546 filed Feb. 1, 1994 now U.S. Pat. No. 5,500,083, the disclosure of which is hereby incorporated by reference herein. By utilizing the hopper with one dimensional convergence in place of the conventional cylindrical chip bin a height reduction on the order about 15 feet can be obtained.

According to another aspect of the present invention, with the new chip chute pump providing the motive force which fills the feeder, the intermediate pressure raising devices of conventional delivery systems can be eliminated. This can be done by operating the chip chute (vessel) at substantially atmospheric pressure (e.g. 1 bar or slightly above), which is connected directly to the chip bin without pressure isolation. That is, the low pressure feeder is eliminated, reducing the height of the delivery system by about five feet.

The height of the delivery system may be reduced even further by replacing the conventional chip chute with a vessel having one dimensional convergence and side relief, such as shown in U.S. Pat. No. 4,958,741. This reduces the height another five to ten feet, approximately.

Utilizing all of the modifications as set forth above, it is possible to provide a delivery system that has a height only 40–50% of conventional systems, without the necessary complex super structure (with associated stairwells, utilities, and the like), concrete pedestal for supporting the high pressure feeder, and the like. For example, instead of a 115 foot high delivery system which is typical for use with a 1,500 ton per day continuous digester (with or without impregnation vessel), a delivery system having a height of about 60 feet may be provided.

Other modifications may be provided too. For example according to another aspect of the present invention a system for delivering slurry to a continuous digester includes the following components associated with the high pressure transfer device: A vessel at superatmospheric pressure containing a slurry of comminuted cellulosic fibrous material, and having a top, a bottom, and an outlet adjacent the bottom. A chip bin mounted above the vessel and connected to the vessel by a low pressure feeder for feeding cellulosic fibrous material to the vessel at superatmospheric pressure. A recirculation loop for returning liquid from the transfer device low pressure outlet to the vessel. And, a substantially atmospheric pressure level tank disposed in the recirculation loop for controlling the level of slurry in the vessel, and a pump between the vessel and the level tank for pressurizing liquid and pumping it from the level tank to the vessel. The transfer device is preferably mounted substantially at ground level. The chip bin is preferably as described above. Also a steam conducting conduit is preferably provided for transporting steam from the liquid flashing in the atmospheric pressure level tank to the chip bin.

One advantage of using an unpressurized, atmospheric level tank is that a larger tank is practical. The present pressurized level tank is limited in size due to the cost of designing and fabricating a larger vessel which meets ASME (i.e. American Society of Mechanical Engineers) pressure vessel design codes. A larger, unpressurized vessel can be built more cheaply. A large, unpressurized level tank would also better control and accommodation of both short- and long-term variations, i.e. "swings", in system operation. Short-term swings include variation in digester production rate and variation in chip feed. Long-term swings include variations in chip moisture or chip volume. Make-up liquor flow from a large level tank to the digester can be controlled by monitoring the pressure in the digester.

According to yet another aspect of the present invention a system for delivering slurry to a continuous digester, in addition to the high pressure transfer device, comprises: A vessel at substantially atmospheric pressure containing a slurry of comminuted cellulosic fibrous material, and having a top, a bottom, and an outlet adjacent the bottom. A substantially atmospheric pressure chip bin mounted above the vessel and connected directly to the vessel without pressure isolation. A recirculation loop for returning liquid from the transfer device low pressure outlet to the vessel. And, a substantially atmospheric pressure level tank disposed in the recirculation loop for controlling the level of slurry in the vessel.

The invention also comprises a comminuted cellulosic fibrous material treatment system. The treatment system includes: A continuous digester having a comminuted cellulosic fibrous material inlet adjacent the top thereof. And, a combination of elements for feeding material slurry to the digester, the combination comprising: a high pressure rotary transfer device having a low pressure inlet, low pressure outlet, high pressure inlet, and high pressure outlet, the high pressure outlet operatively connected to a continuous digester for feeding comminuted cellulosic fibrous material slurry to the digester; a vessel containing a slurry of comminuted cellulosic fibrous material, and having a top, a bottom, and an outlet adjacent said bottom; a chip bin mounted above the vessel and connected to the vessel for feeding cellulosic fibrous material to the vessel; a recirculation loop for returning liquid from the transfer device low pressure outlet to the vessel; and a level tank disposed in the recirculation loop for controlling the level of slurry in the vessel. And, the combination of elements having a maximum height which is less than about 35% of the height of the digester.

Utilizing the system described above, a method of delivering a slurry of chips to the continuous digester (either through an impregnation vessel, or directly to the top of the digester) is provided which allows operation of the high pressure transfer device at a significantly higher operating speed than conventional, e.g. at operating speeds of about 15 rpm or higher, with a commensurate increase in capacity.

It is the primary object of the present invention to provide a less costly, improved, delivery system for delivering comminuted cellulosic fibrous material slurry to a continuous digester. This and other objects of the invention will become clear from an inspection of the detailed description of the invention, and from the appended claims.

BRIEF DESCRIPTION OF THE DRAWINGS

FIG. 10 is an end view of the slurry containing vessel of the FIG. 9 embodiment;

FIG. 11 is a side view of the vessel of FIG. 10; and

FIGS. 12 through 14 are cross-sectional views of the vessel of FIG. 11 taken along lines 12—12, 13—13, and 14—14 thereof, respectively.

DETAILED DESCRIPTION OF THE DRAWINGS

Figure 1:
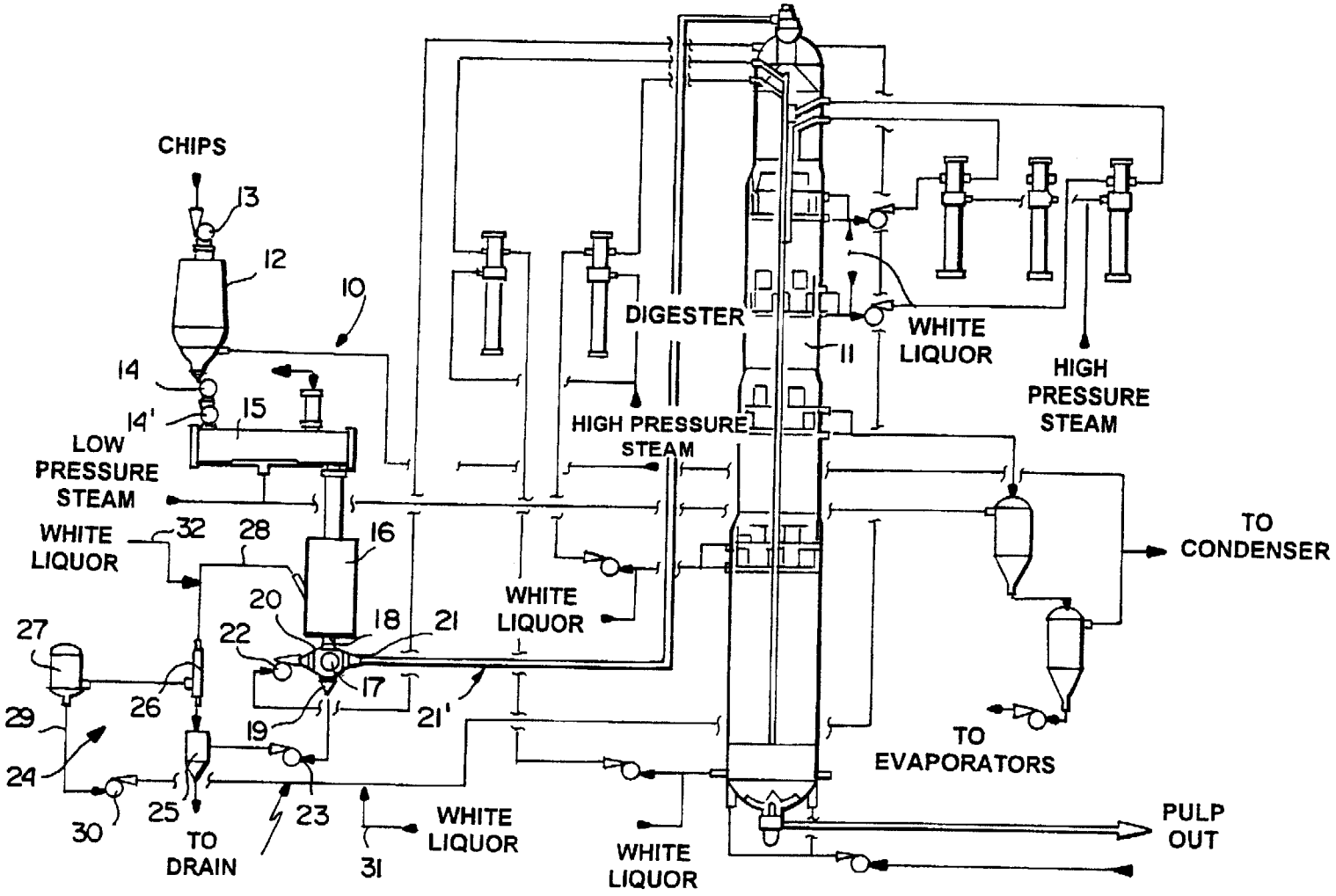
fig. 1 (prior art)
FIG. 1 is a schematic view of conventional prior art chips delivery system for a continuous digester.

The conventional system of FIG. 1 includes a comminuted cellulosic fibrous material (e.g. wood chips) slurry delivery system 10 associated with a conventional continuous digester 11, such as sold by Kamyr, Inc. of Glens Falls, N.Y. The delivery system 10 includes a generally cylindrical chips bin 12 such as shown in Canadian patent 1,154,622 having an air lock 13 at the top thereof, and a chip meter 14 and low pressure feeder 14' mounted below it for connecting the chip bin 12 to a horizontal steaming vessel 15. Connected to the bottom of the horizontal steaming vessel 15 is a chip chute 16, which in turn is mounted above and connected to a high pressure transfer device 17. The transfer device 17 includes a low pressure inlet 18, a low pressure outlet 19, a high pressure inlet 20, and a high pressure outlet 21. The high pressure outlet 21 is operatively connected to a continuous digester 11, either directly to the top of the digester 11 as seen in FIG. 1, or through an impregnation vessel, or the like. The high pressure pump 22 provides the motive force for pumping the slurry in the line 21' connected to outlet 21 to the digester 11. A chip chute pump 23 is mounted below the device 17 providing the suction source for pulling liquid in the low pressure line through the low pressure outlet 19 into a recirculation loop 24. The recirculation loop 24 typically includes a sand separator 25, an in-line drainer 26 connected to a level tank 27, and a return line 28 to the chip chute 16. The level tank 27—which is at superatmospheric pressure—controls the level of liquid in the chip chute 16, with excess liquid being removed in line 29 and pumped by pump 30 to where desired in the system (e.g. to the top of the digester 11 with white liquor being added thereto as indicated at 31 in FIG. 1). White liquor can also be added at 32 in the recirculation loop 24, if desired.

Figure 2:
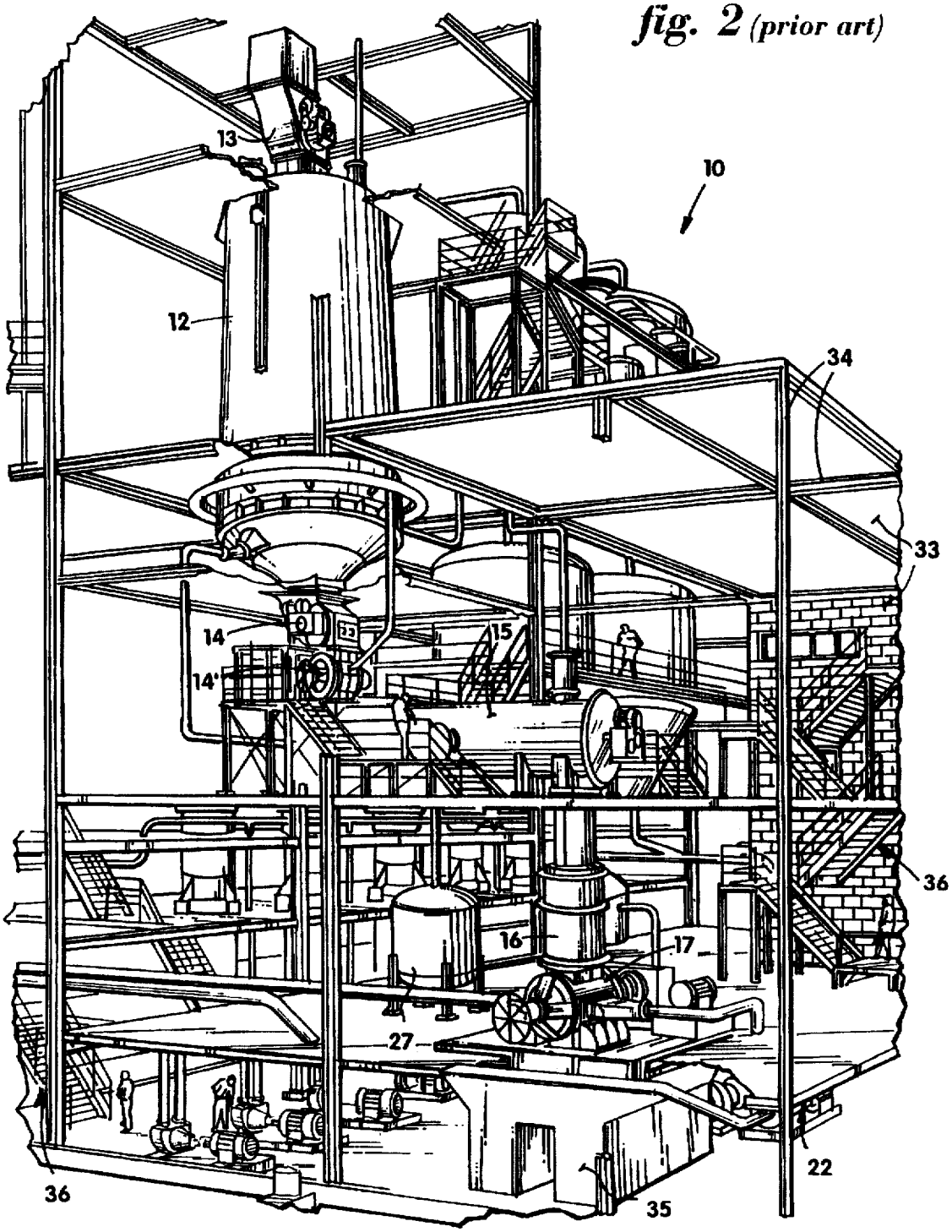
fig. 2 (prior art)
FIG. 2 is an isometric view of a typical building/super structure for mounting the chip delivery system of FIG. 1.

FIG. 2 illustrates how components of the delivery system 10 look in an actual digester assembly, shown associated with a building or super structure shown generally by reference numeral 33, which includes structural steel 34, a concrete pedestal 35 for mounting the feeder 17 with the chip chute pump 23 disposed below the device 17 within the pedestal 35, stairwells 36, utilities, and the like. A conveyor for delivery of chips to the airlock 13 is not shown in FIG. 2, but is a massive structure the cost of which ii typically directly related to the height of the system 10.

Figures 3, 4, 6, 7, 9:
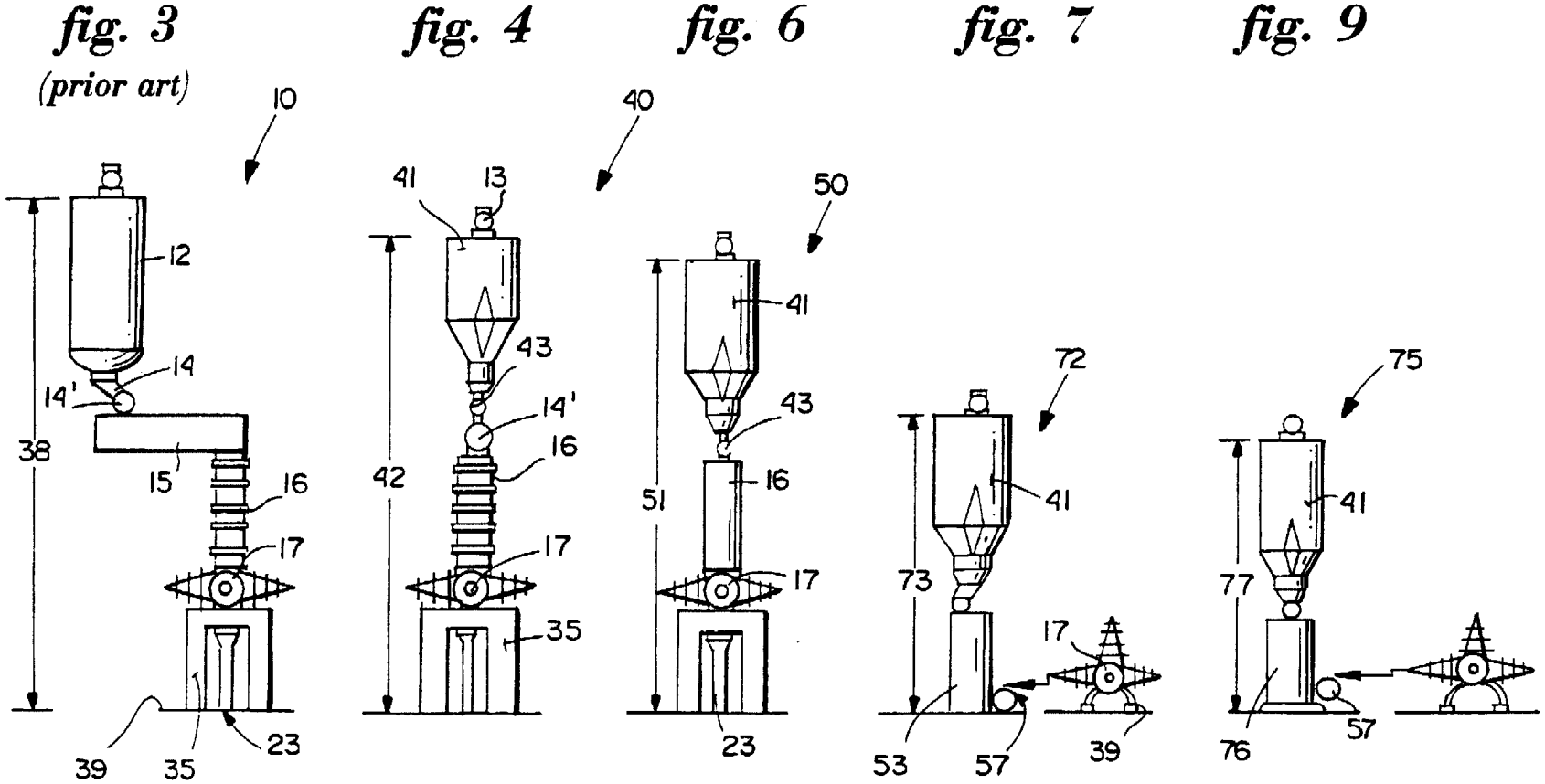
fig. 3 (prior art)
FIG. 3 is a side schematic view of the delivery system of FIGS. 1 and 2.
FIG. 4 is a view like that of FIG. 3 of a first embodiment of an exemplary system according to the present invention.
FIG. 6 is a view like that of FIG. 4 for a third exemplary system according to the invention.
FIG. 7 is a view like that of FIG. 6 for a fourth exemplary modification of the system according to the present invention.
FIG. 9 is a view like that of FIG. 7 only of a fifth embodiment of the system according to the invention.

The height of the system 10 is illustrated schematically in FIG. 3 by reference numeral 38, which is typically about 115 feet for a 1500 ton/day continuous digester. The pedestal 35 rests on the ground 39 within the building 33.

FIG. 4 shows a first embodiment of the delivery system 40 according to the present invention. The components of the delivery system 40 that are the same as those in the prior art system 10 are shown by the same reference numerals. The system 40 differs from the system 10 only in the provision of a new type of chip bin. Instead of using a conventional generally cylindrical chip bin 12, and steaming vessel 15, the chip bin 41 comprises a hopper with two transitions with one dimensional convergence and side relief. The chip bin 41 is preferably as disclosed in co-pending application Ser. No. 08/189,546 filed Feb. 1, 1994, the disclosure of which is hereby incorporated by reference herein, comprising a "DOUBLE DIAMOND BACK" hopper design such as available from J. R. Johanson, Inc. of San Luis Obispo, Calif., and as generally shown in U.S. Pat. No. 4,958,741. The hopper 41 has steaming associated therewith, as shown in said application Ser. No. 08/189,546 now U.S. Pat. No. 5,500,083. Utilizing the configuration of FIG. 4, the height 42 of the delivery system 40 is about fifteen feet less than the height 38 of the conventional system of FIG. 3. For example if the conventional system 10 has a height 38 of about 115 feet, the height 42 is about 100 feet.

Figure 5:
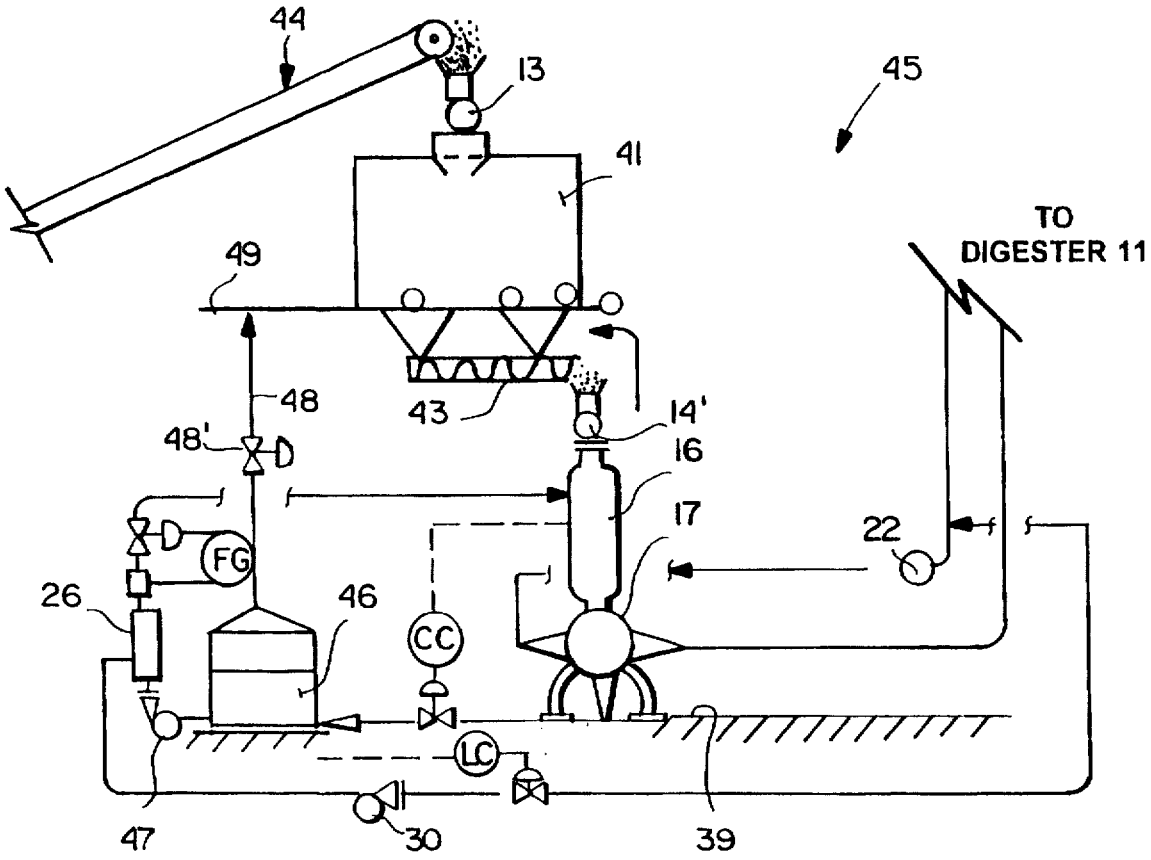
FIG. 5 is an end schematic view of a second modification of a delivery system according to the present invention.

FIG. 5 shows a modification of the delivery system of FIG. 4 in which the high pressure feeder 17 is mounted substantially at ground level 39. The "DOUBLE DIAMOND BACK" design of the hopper 41 is more visible in FIG. 5, as is the screw feeder 43 associated therewith. Also in this embodiment a conventional type of conveyor system 44 is illustrated for delivering chips to the top of the air lock 13.

In the FIG. 5 embodiment, it is possible to mount the high pressure feeder 17 at ground level (which reduces the delivery system 45 by the height of the concrete pedestal 35) by providing the level tank 46 at substantially atmospheric pressure. The pump 23 of the conventional system is not utilized, but a pump 47 is provided on the opposite side of the atmospheric pressure level tank 46 from the high pressure feeder 17 for recirculating liquid from tank 46 to the chute 16 to maintain the desired slurry level within the chute 16. The pressure in the chip chute 16 forces the slurry into the high pressure feeder 17 so that the system of FIG. 5 is essentially a "push-through" system rather than a suction system. Steam that flashes when the hot liquor enters the atmospheric pressure level tank 46 passes in steam conducting conduit 48 to supplement the steam added through steam line 49 leading to the hopper/chip bin 41 to steam the chips therein. Note pressure control valve 48' in FIG. 5 to control the steam volume supplied to the chip bin 41.

The delivery system 50 of FIG. 6 is similar to the system 40 except that the chute 16 is an atmospheric pressure chute rather than superatmospheric pressure (as for the systems 10, 40). The chip bin 41 is directly connected (through feeder 43) to the chute 16 without pressure isolation. That is, the low pressure feeder 14' is eliminated. The height 51 of the system 50 is thus about five feet less than the height 42, e.g. about 95 feet.

Figure 8:
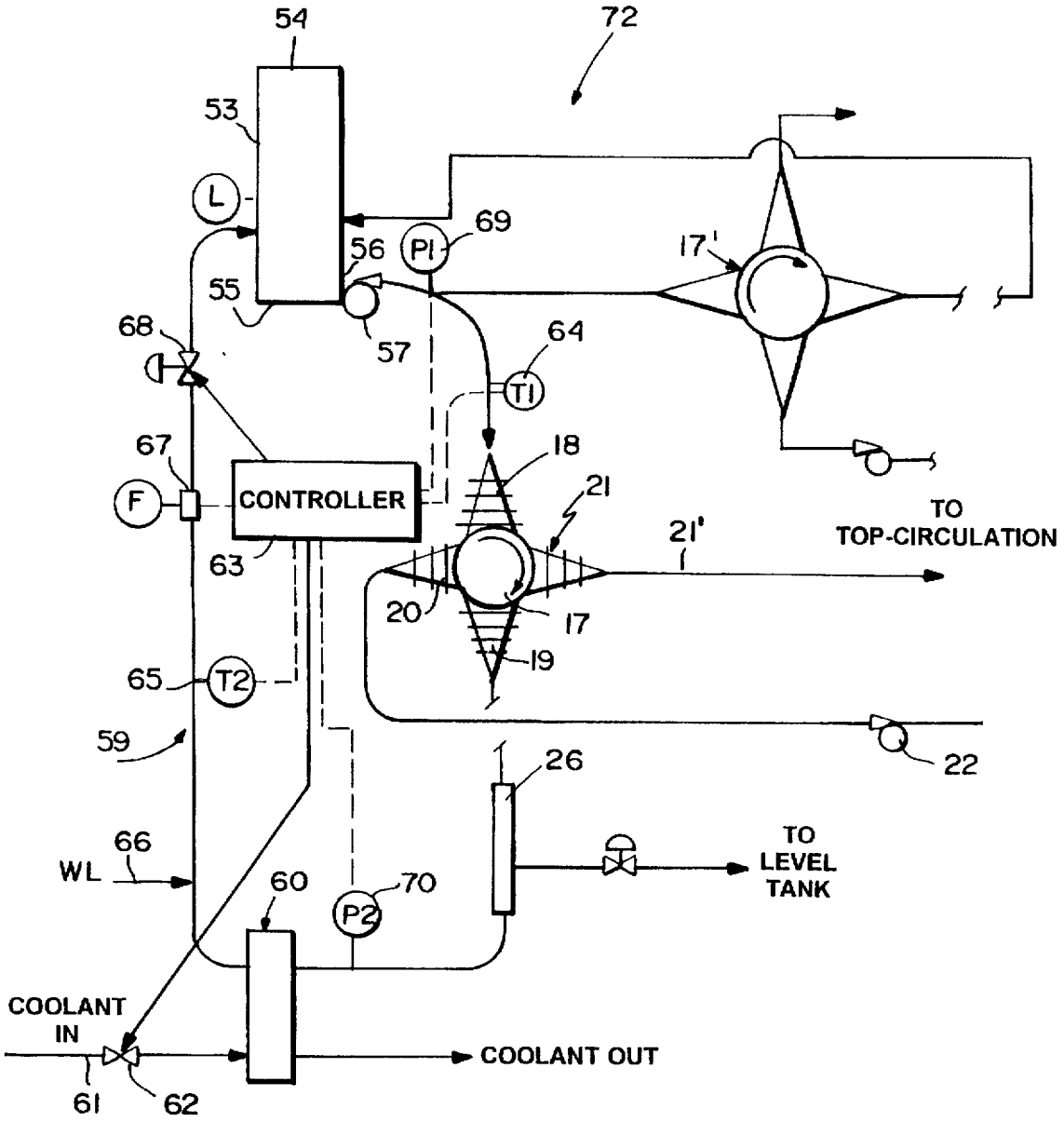
FIG. 8 is a schematic view of the system of FIG. 7 without the chip bin, but showing the recirculation loop and other components associated therewith.

FIGS. 7 and 8 show components of the system according to the invention which has the greatest affect on height reduction of the delivery system, and also effectively increases the capacity of the high pressure feeder 17. In the FIG. 7 embodiment, the vessel for containing the slurry instead of comprising a chute 16 comprises a standard generally cylindrical upright vessel 53 having a top 54 (see FIG. 8) and a bottom 55, with a slurry outlet 56 adjacent the bottom 55. The chip chute pump 23 is eliminated, and instead a pump-through system is provided by utilizing the slurry pump 57 which pumps the slurry from the vessel 53 into the low pressure inlet 18 of the high pressure transfer device 17. A recirculation loop 59 returns liquid from the transfer device 17 to the vessel 53.

As seen in the preferred embodiment of FIG. 8, some of the liquid in the recirculation loop 59 is withdrawn through the in-line drainer 26 and passes to a level tank, e.g. an atmospheric pressure level tank such as the tank 46 in the FIG. 5 embodiment. The rest of the fluid passes in the loop 59 ultimately back to the vessel 53 (of course a sand separator and other conventional equipment can also be included in the recirculation loop 59). In order to minimize or eliminate water hammer from flashing of the liquid, the liquid being recirculated may be positively cooled or otherwise have its temperature reduced, as by utilizing the temperature reduction means 60. The means 60 may simply be a device for allowing some of the liquor to expand and flash, the flashed steam is removed; of—as illustrated in FIG. 8—the means 60 may comprise an indirect heat exchanger including a flow of coolant 61 thereto. The flow of coolant in line 61 is controlled by controlling the valve 62 utilizing a conventional controller 63. Data for controlling the flow of coolant through the valve 62 is provided by utilizing the first temperature sensor 64 which is between the pump 57 and the transfer device 17, and the second temperature sensor 65 which is between the indirect heat exchanger 60 and the vessel 53. Depending upon the temperatures sensed by the sensors 64, 65 the controller 63 controls the valve 62 to either allow more coolant to flow to the heat exchanger 60, or less. As seen in FIG. 8, white liquor can be added downstream of the cooler 60, as illustrated by line 66.

The temperature of the liquor in this return recirculation, 59, can also be controlled by cooling the white liquor before adding it at 66. Similar methods to those used in U.S. Pat. No. 5,302,247 may be used to cool the white liquor. This white liquor cooling may be controlled based on the temperature sensed at upstream temperature sensor 64.

The recirculation loop 59 also typically includes a flow meter 67, a flow control valve 68, a first pressure sensor 69, and a second pressure sensor 70. The pressure sensors 69, 70 are on opposite sides of the transfer device 17, and a high pressure drop indicates pluggage of either the in-line drainer 26 or the high pressure feeder 17. A pressure drop between the sensors 64, 70 can be controlled by controlling the valve 68 via the controller 63, including data from the flow meter 67.

An alternate control method can be to control the flow through meter 67 via valve 68 and then use the pressure drop across sensors 69 and 70 to control the speed of the feeder 17. As the pressure drop increases the speed of the variable-speed-motor-driven feeder can be decreased.

Utilizing the system as illustrated in FIG. 8, a number of different high pressure transfer devices may be operated from the same vessel 53 and pump 57. For example FIG. 8 shows a second high pressure transfer device 17' which is also fed with slurry by the slurry pump 57. These feeders can feed one or more digesters. The use of the pump through system as illustrated in FIG. 8 allows the feeder or feeders 17, 17' to run faster and have a higher capacity, the feeders 17, 17' being in parallel. Thus the design of new systems can be simplified, and the capacity of the existing systems increased. For example the speed of one typical high pressure feeder 17 can be increased from about 11 rpm to up to about 15 rpm or even higher. This ability to increase the effective capacity of the high pressure feeder is worthwhile by itself, the art long having struggled with the need to increase the effective capacity of the high pressure feeder (e.g. see U.S. Pat. Nos. 5,236,285 and 5,236,286). These feeders can have individual chip chute circulation components (i.e., level tanks, in-line drainers, etc.) or can have common components.

The system 72 of FIGS. 7 and 8 has a height 73 which is about 20–30 (typically about 25–30) feet less than if the pump-through system had not been used. For example the height 73—which is even less than the height of the system 45 of FIG. 5—may be about 68 feet.

FIG. 9 illustrates a system 75 which has yet one additional height minimizing feature. The system 75 is just like the system 72 except that instead of the vessel 53 being a conventional essentially cylindrical vessel, it is a vessel having one dimensional convergence and side relief, being shown generally by reference numeral 76 in FIGS. 9 through 14, such as illustrated in U.S. Pat. No. 4,958,741 and available under the trademark "DIAMONDBACK HOPPER" from J. R. Johanson, Inc. of San Luis Obispo, Calif. The height 77 of the system 75 is about sixty feet, i.e. about 40–50% of the height 38.

FIGS. 10 through 14 illustrate the vessel 76 in more detail, the one dimensional convergence thereof being clearly evident in FIGS. 10 and 11, and the cross-sectional configuration thereof at the levels indicated by the section lines 12—12 through 14—14 being illustrated in FIGS. 12 through 14, respectively. That is, the vessel 76 at the top 78 thereof—which is connected to the chip bin 41—has a section 79 which is basically circular in cross-section as illustrated in FIG. 12. The tapered/converging area 80 has a generally "racetrack oval" type configuration, as seen in FIG. 13. The bottom section 81, which is connected through the elbow 83 to the slurry pump 57, also has a generally circular cross-section as illustrated in FIG. 14, of a diameter only about 10–40% that the diameter of the section 79. Note that the section 81 is not circular throughout its entire height, but only at the bottom 82 thereof which is connected to the elbow 83, the section 81 providing a transition between the racetrack shape 80 and the circular shape 82.

The combination of elements provided according to the invention thus has a maximum height which is much less than for conventional delivery systems. For example, the maximum height of the system according to the present invention has less than about 35% the height of the digester 11, whereas in the prior art the conventional delivery systems have a height that is about 60 to 70% that of the digesters with which they are associated.

It will thus be seen that according to the present invention a highly advantageous system has been provided which greatly minimizes the costs of a pulp mill while increasing the capacity. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent systems and devices.

What is claimed is:

1. A feed chute assembly for a slurry of comminuted cellulosic fibrous material composing:

a vessel having a top section which is basically circular in cross-section, a tapered converting area that has a generally racetrack oval-type configration and extends from said top section to a bottom section having a bottom opening generally circular in cross-section with a diameter of about 10–40% the diameter of the top section, and a bottom section transition between said tapered converting area and said bottom opening;

said bottom opening directly connected to an inlet for a pump for pumping the slurry; and wherein said vessel has one dimensional convergence and side relief.

2. An assembly as recited in claim 1 wherein said bottom opening is directly connected to said pump inlet by an elbow having substantially the same diameter as said bottom opening.

3. An assembly as recited in claim 2 further comprising a chip bin mounted above said vessel and having a bottom discharge connected to said top section of said vessel.

4. An assembly as recited in claim 3 wherein said chip bin has one dimensional convergence and side relief.

5. An assembly as recited in claim 4 wherein said assembly has a height from a support for said pump to the top of said chip bin of about 60 feet.

6. An assembly as recited in claim 5 wherein said pump is operatively connected to a continuous digester.

7. An assembly as recited in claim 4 wherein said pump is operatively connected to a continuous digester.

8. An assembly as recited in claim 3 wherein said pump is operatively connected to a continuous digester.

9. An assembly as recited in claim 2 wherein said pump is operatively connected to a continuous digester.

10. An assembly as recited in claim 1 wherein said pump has an outlet connected to a high pressure transfer device, which in turn is connected to a continuous digester.

11. An assembly as recited in claim 1 wherein said pump is operatively connected to a continuous digester.

* * * * *

UNITED STATES PATENT AND TRADEMARK OFFICE

CERTIFICATE OF CORRECTION

PATENT NO. : 5,700,355
DATED : December 23, 1997
INVENTOR(S) : PROUGH, Robert J.

It is certified that error appears in the above-identified patent and that said letters patent is hereby corrected as shown below:

Column 10, line 11, replace "converting" with -- converging --; and
line 17, replace "converting" with -- converging --.

Signed and Sealed this

Twenty-third Day of June, 1998

*Attest:*

Bruce Lehman

BRUCE LEHMAN

*Attesting Officer*

*Commissioner of Patents and Trademarks*